United States Patent [19]

Stout et al.

[11] 4,047,610

[45] Sept. 13, 1977

[54] ARTICLE CARRIER

[75] Inventors: James T. Stout, Acworth; Robert E. Plaxico, Lithonia, both of Ga.

[73] Assignee: The Mead Corporation, Dayton, Ohio

[21] Appl. No.: 739,873

[22] Filed: Nov. 8, 1976

[51] Int. Cl.[2] ..... B65D 5/46; B65D 25/04

[52] U.S. Cl. ..... 206/187; 229/28 BC

[58] Field of Search ..... 206/170–193, 206/427, 434; 229/28 BC, 41 R, 41 B, 52 BC

[56] References Cited

U.S. PATENT DOCUMENTS

| | | | |
|---|---|---|---|
| 2,371,471 | 3/1945 | Rothstein | 229/52 BC X |
| 2,472,698 | 6/1949 | Edtmiller | 229/41 B X |
| 2,572,123 | 10/1951 | Edtmiller | 229/41 B X |
| 2,606,711 | 8/1952 | Ferber | 206/184 |
| 2,616,611 | 11/1952 | Arneson | 206/186 |
| 2,657,851 | 11/1953 | Metzger | 229/41 B X |
| 2,755,961 | 7/1956 | Ringler | 206/189 |
| 2,794,571 | 6/1957 | Fielding | 206/175 |
| 2,800,250 | 7/1957 | Buttery | 206/173 |
| 2,808,177 | 10/1957 | Buttery | 206/175 |
| 2,860,816 | 11/1958 | Fielding | 206/173 |
| 2,881,946 | 4/1959 | Bosrock et al. | 206/171 |
| 3,421,684 | 1/1969 | Stout, Sr. et al. | 206/170 X |
| 3,784,053 | 1/1974 | Stout | 206/193 |

*Primary Examiner*—Stephen Marcus
*Attorney, Agent, or Firm*—Walter M. Rodgers; Walter A. Rodgers,

[57] ABSTRACT

An article carrier primarily adapted for the packaging of large primary packages comprises spaced side walls, end wall panels foldably joined to the ends of the side walls and extending inwardly, riser panels foldably joined to the end wall panels remote from the side walls and extending medially inward of the carrier, a multiple ply handle secured to the upper portions of the riser panels, a pair of bottom panels foldably joined respectively to the lower edges of the side walls, a reinforcing panel foldably joined to one of the bottom panels, a web foldably joined to the reinforcing panel generally remote from the bottom panel and disposed in overlapping relation with the reinforcing panel, an attachment flap secured in flat face contacting relation with the adjacent one of the end wall panels and foldably joined to the web, and the fold line between the reinforcing panel and the one bottom panel being disposed in the same horizontal plane as the lower edge of the end wall panel and being angularly related horizontally therewith.

7 Claims, 9 Drawing Figures

ARTICLE CARRIER

With the advent of larger and larger primary packages, it has become necessary to provide article carriers which are strong and resistant to collapse whenever one unit is removed from the carrier. One known method of increasing the strength and structure integrity of article carriers is to provide a web panel which is foldably connected to an end edge of the bottom of the carrier and foldably joined to the lower edge of an adjacent end wall panel. This type of structure is of limited strength in that the amount of reinforcement material which is disposed beneath the packaged primary items is limited and the unit area loading is therefore substantial and the resulting tendency to cause tearing along adjacent fold lines is significant. With the large primary packages currently being used, such structures are not adequate.

According to this invention, an article carrier is provided and comprises opposed side walls, end wall panels foldably joined to the end edges of the side walls and extending inwardly therefrom, riser panels foldably joined to the end wall panels remote from the side walls and extending medially inward of the carrier, a multiple ply handle secured to the upwardly extending portions of the riser panels, a bottom panel foldably joined to the lower edge of one side wall, a reinforcing panel foldably joined to the bottom panel, a web foldably joined to the reinforcing panel and disposed in overlapping relation therewith, and an attachment flap secured in flat face contacting relation with the lower part of one end wall panel and foldably joined along one edge thereof to the web.

For a better understanding of the invention, reference may be had to the following detailed description taken in conjunction with the accompanying drawings in which FIG. 1 is an isometric view of a set up carrier constructed according to the invention and in which the articles ordinarily disposed within the carrier cells have been removed for clarity;

FIG. 2 is a plan view of the blank from which the carrier of FIG. 1 is formed; and in which

Figure 1:
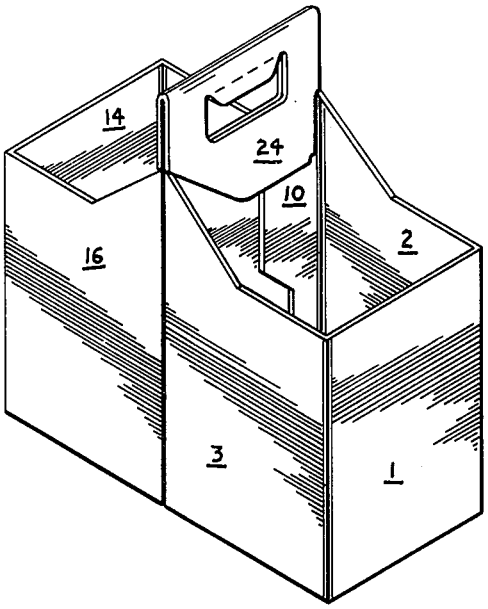
FIG. 1A is a view similar to FIG. 1 with portions of the carrier broken away.
FIG. 1B is a bottom view of the carrier.
Figure 1A:
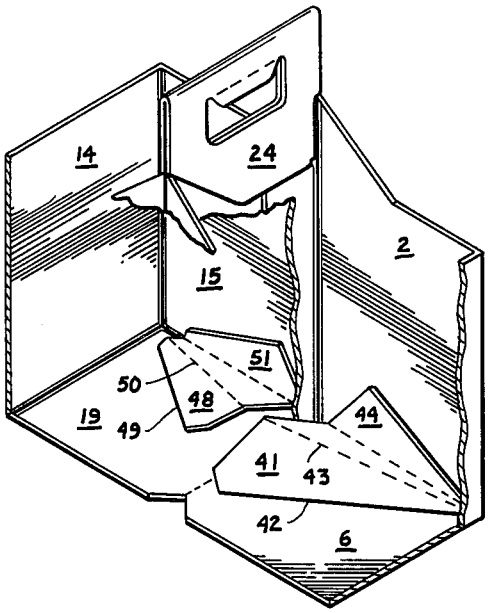

In the drawings, the numeral 1 designates a side wall of the carrier to the end edges of which end wall panels 2 and 3 are foldably joined respectively along fold lines 4 and 5. Bottom panel 6 is foldably joined to the lower edge of side wall 1 along fold line 7. On the opposite side of bottom panel 6, a glue flap 8 is foldably joined thereto along fold line 9. Disposed at one end of fold line 9 is a notch 9*a*.

Riser panels 10 and 11 are foldably joined respectively to end wall panels 2 and 3 along fold lines 12 and 13. Disposed at the lower end of fold line 12 is cut 12*a*. Riser panel 10 is provided with a notch 10*a* while, similarly, riser panel 11 is provided with notch 11*a*.

The other side of the blank is similarly constructed and comprises a side wall 14 along each end edge of which end wall panels 15 and 16 are foldably joined respectively along fold lines 17 and 18. Bottom panel 19 is joined to side wall 14 along fold line 20. Riser panels

21 and 22 are joined to end wall panels 15 and 16 respectively along fold lines 23 and 24. Disposed at the lower end of fold line 23 is cut 23*a*. Also riser panel 21 is provided with a notch 21*a* and riser panel 22 is provided with a notch 22*a*.

The handle structure for the carrier comprises handle panels 24 and 25 which are foldably joined respectively to riser panels 11 and 22 along fold lines 13 and 24. Formed in handle panel 24 is a hand gripping aperture 26 and, similarly, hand gripping aperture 27 is formed in handle panel 25. In order to facilitate transport of the carrier, hand gripping aperture 26 is provided with a hand cushioning flap 28 which is joined to handle panel 24 along fold line 29. In like manner hand cushioning flap 30 is joined to handle panel 25 along fold line 31. In addition to handle panels 24 and 25, handle panels 32 and 33 are provided and are foldably joined respectively to handle panels 24 and 25 along fold lines 34 and 35. Handle panel 32 is provided with aperture 36 and handle panel 33 is provided with aperture 37. Handle panels 24 and 32 are joined to handle panels 25 and 33 along interrupted medial fold line 38.

Figure 2:
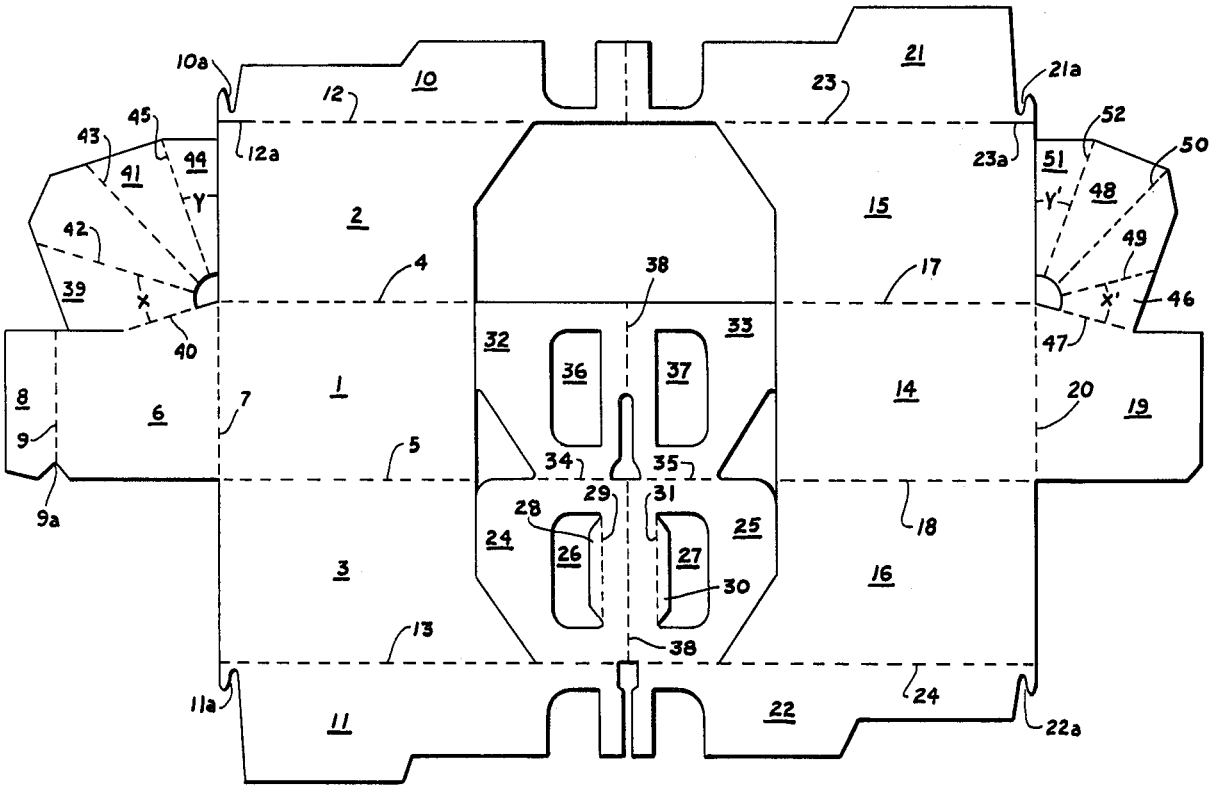

In accordance with this invention and formed on one side of the blank, as viewed in FIG. 2, a reinforcing panel 39 is provided and is foldably joined to bottom panel 6 along angular fold line 40. Web 41 is joined to reinforcing panel 39 along fold line 42. In order to absorb possible bending of web 41, a score line 43 is provided in web 41. Also an attachment flap 44 is joined to web 41 along fold line 45. According to a feature of this invention, attachment flap 44 is completely severed from the adjoining end wall panel 2, as best seen in the blank of FIG. 2.

Similar structure is formed on the other side of the blank and comprises a reinforcing panel 46 which is joined to bottom panel 19 along angular fold line 47. Web 48 is foldably joined to the reinforcing panel 46 along fold line 49 and is provided with score line 50. In addition attachment flap 51, which is severed from end wall panel 15, is joined to web 48 along fold line 52.

Figure 3:
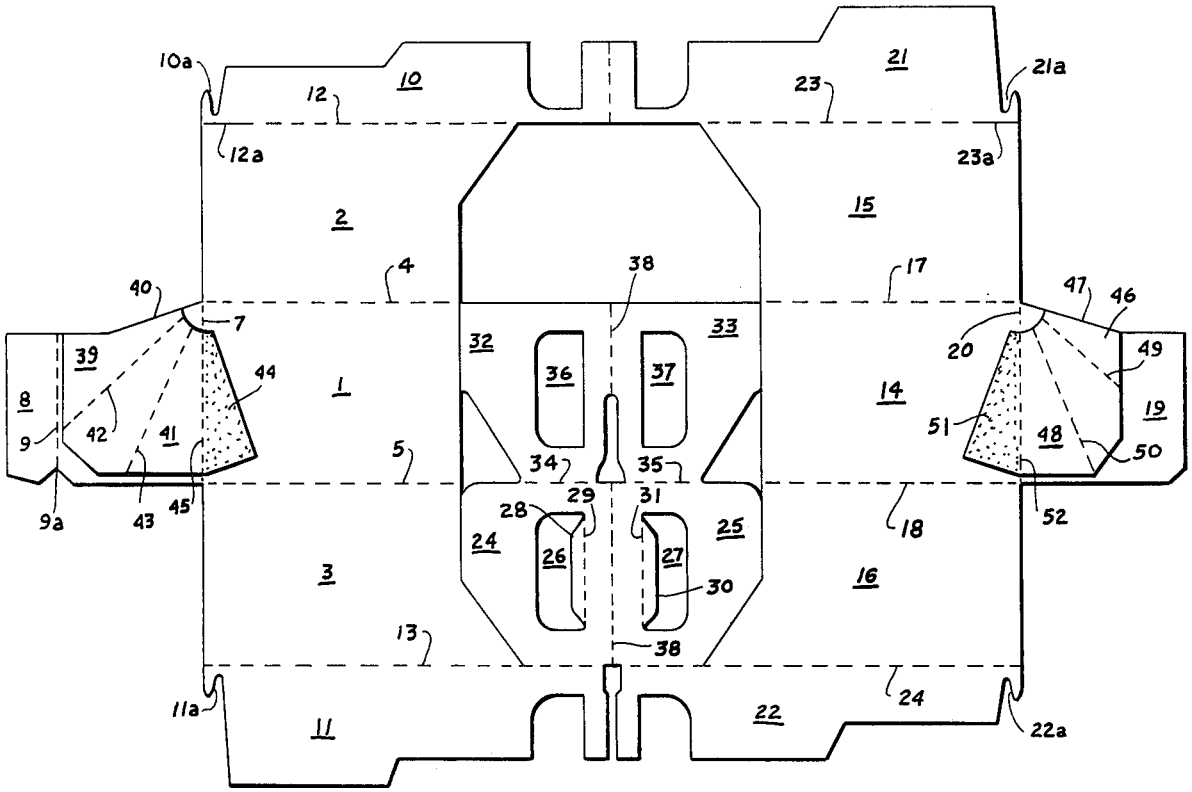

In order to form the completed carrier from the blank shown in FIG. 2, reinforcing panel 39, web panel 41, and attachment flap 44 are all folded upwardly and over along angular fold line 40. In similar fashion, reinforcing panel 46, web 48, and attachment flap 51 are all folded upwardly and over along angular fold line 47. The blank then appears as shown in FIG. 3. Since angular fold lines 40 and 47 are angularly disposed with respect to fold lines 4 and 17 and angles $x$ and $x'$ are twice the dimension of angles $y$ and $y'$, fold lines 45 and 52 are parallel and immediately adjacent fold lines 7 and 20 respectively.

Figure 4:
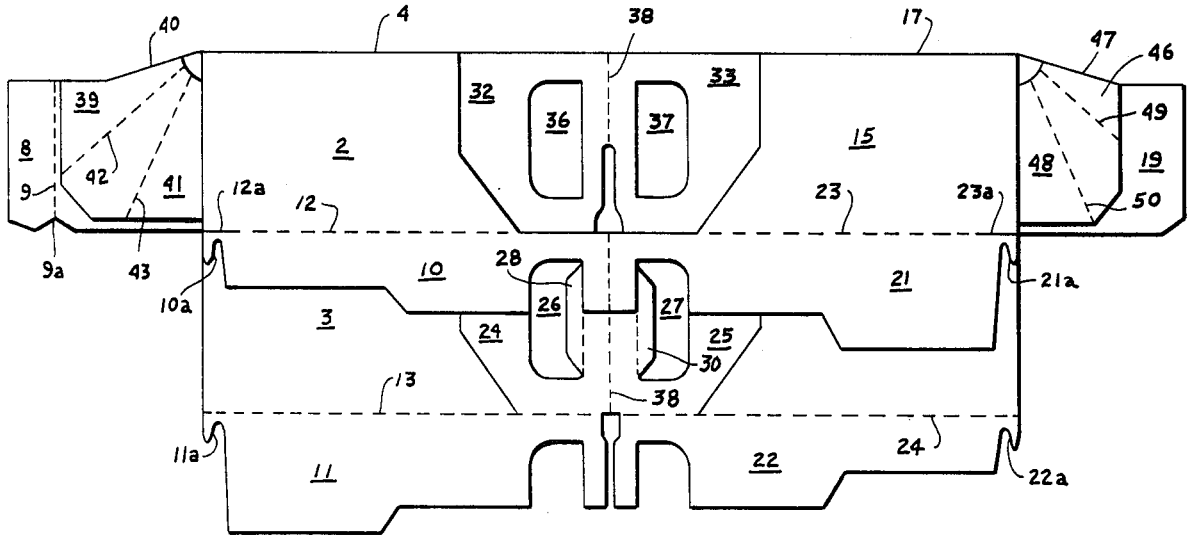

Following this folding operation, an application of glue is made to attachment flaps 44 and 51 as indicated by stippling in FIG. 3. Then end wall panels 2 and 15 together with riser panels 10 and 21 are all folded upwardly and over into the positions shown in FIG. 4. By this operation attachment flaps 44 and 51 become adhered respectively to end wall panels 2 and 15.

Figure 5:
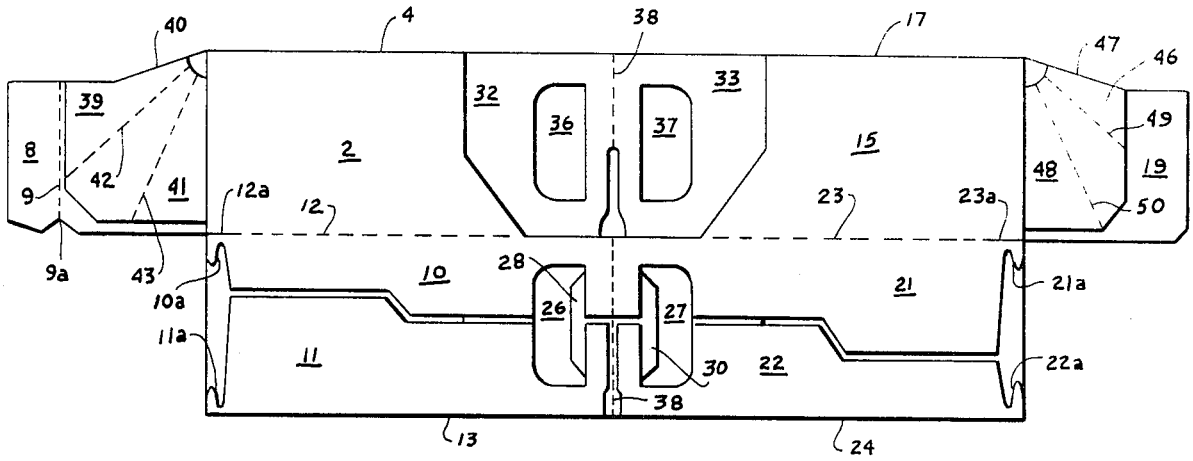
FIGS. 3, 4, 5 and 6 represent intermediate stages through which the blank of FIG. 2 is manipulated in order to form the collapsed completed carrier as depicted in FIG. 7 which when set up occupies the orientation depicted in FIG. 1.
Figure 6:
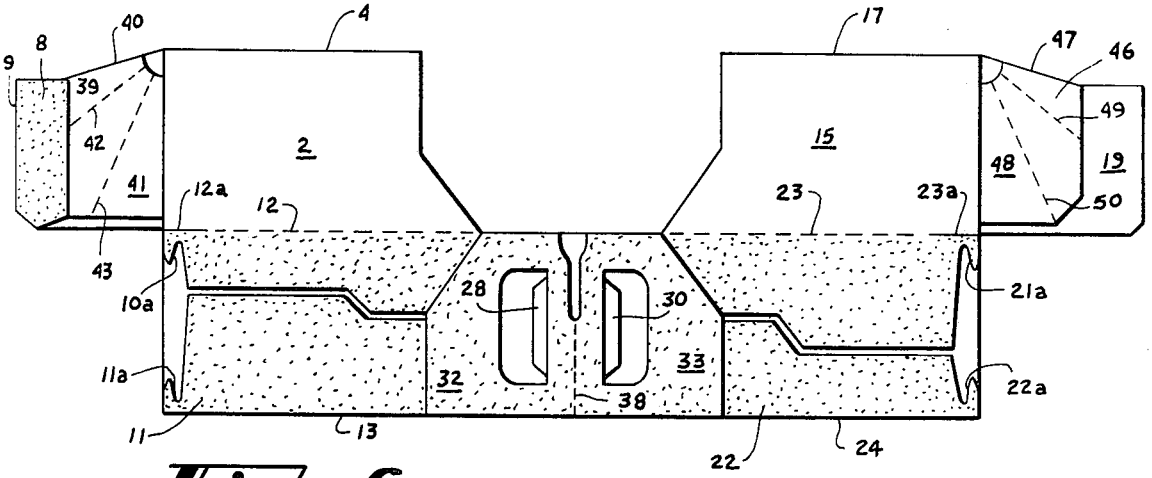

Following this operation, riser panels 11 and 22 are folded upwardly and over along fold lines 13 and 24 respectively. The carrier then appears as shown in FIG. 5. Then handle panels 32 and 33 are folded upwardly and over respectively along fold lines 34 and 35. Also glue flap 8 is folded over along fold line 9. The carrier then appears as shown in FIG. 6. Following this an application of glue is applied to the carrier as shown by stippling in FIG. 6. More specifically glue is applied to glue flap 8, riser panels 10, 11, 21 and 22, as well as to handle panels 32 and 33. Then the portions of the blank disposed to the left of medial fold line 38, as viewed in FIG. 6, are swung upwardly and to the right to occupy the positions as shown in FIG. 7 which represents the completed carrier in collapsed condition.

Figure 7:
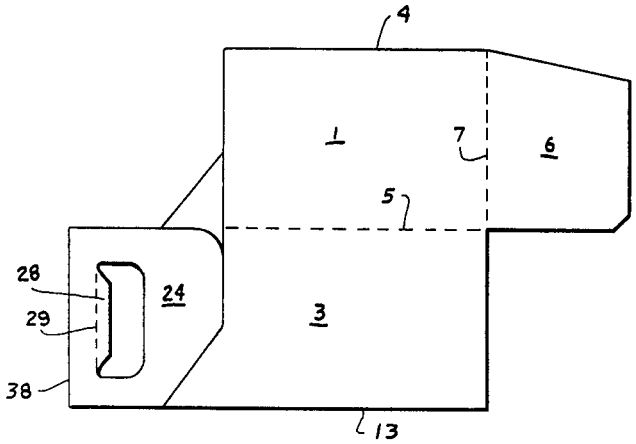
Figure 1B:
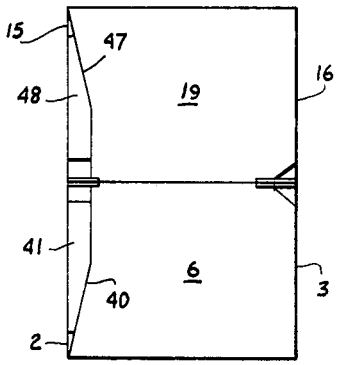

In order to set up the carrier as depicted in FIG. 1 from the collapsed condition shown in FIG. 7, it is simply necessary to prevent side walls 1 and 14 from moving and then to exert a pressure along the inner edges of end wall panels 3 and 16. Simultaneously with this operation side walls 1 and 14 are moved apart and notches 10*a*, 11*a*, 21*a* and 22*a* become locked in notch 9*a* as is well known.

Therefore by this invention, an article carrier is provided which is well adapted for the packaging of extremely large primary packages by the utilization of a reinforcing structure which takes advantage of maximum article contact.

The embodiments of the invention in which an exclusive property or privilege is claimed are defined as follows:

1. An article carrier comprising opposed side walls, end wall panels foldably joined to the end edges of said side walls and extending inwardly therefrom, riser panels foldably joined to said end wall panels remote from said side walls and extending medially inward of the carrier, a multiple ply handle secured to the upwardly extending portions of said riser panels, a bottom panel foldably joined to the lower edge of one of said side walls, a reinforcing panel foldably joined to said bottom panel, a web foldably joined to said reinforcing panel and disposed in overlapping relation therewith, and an attachment flap secured in flat face contacting relation with the lower part of the adjacent one of said end wall panels and foldably joined along one edge thereof to said web.

2. An article carrier according to claim 1 wherein the fold line between said bottom panel and said reinforcing panel is disposed in generally the same horizontal plane as the lower edge of said one end wall panel and angularly related horizontally therewith.

3. An article carrier according to claim 1 wherein the fold line between said web and said attachment flap is disposed adjacent and parallel to the lower edge of said one end wall panel.

4. An article carrier according to claim 1 wherein said reinforcing panel is disposed in flat face contacting relation with said bottom panel.

5. An article carrier blank comprising a pair of handle panels foldably joined together along a medial fold line, a pair of riser panels foldably joined respectively to said pair of handle panels, a first pair of end wall panels foldably joined respectively to said pair of riser panels, a pair of side walls foldably joined respectively to said pair of end wall panels remote from said riser panels, a second pair of end wall panels foldably joined respectively to said pair of side walls remote from said first pair of end wall panels, a bottom panel foldably joined to the lower edge of one of said side walls, a reinforcing panel foldably joined to an end edge of said bottom panel, a web foldably joined to said reinforcing panel, an attachment flap foldably joined to said web, and the fold line between said bottom panel and said reinforcing panel being disposed in angular relation to the fold line between the adjacent one of said second pair of end wall panels and said one side wall and being disposed at an acute angle to the fold line between said bottom panel and said one side wall.

6. An article carrier blank according to claim 5 wherein the angle formed by said fold line between said bottom panel and said reinforcing panel and the fold line between said reinforcing panel and said web is twice the angle formed by the fold line between said web and said attachment flap and said fold line between said bottom panel and said one side wall.

7. An article carrier blank according to claim 5 wherein said attachment flap is severed from the adjacent one of said second pair of end wall panels.

* * * * *